US012290222B1

(12) United States Patent
Glass

(10) Patent No.: US 12,290,222 B1
(45) Date of Patent: May 6, 2025

(54) BROOM ASSEMBLY

(71) Applicant: Vickie L. Glass, Wichita, KS (US)

(72) Inventor: Vickie L. Glass, Wichita, KS (US)

( * ) Notice: Subject to any disclaimer, the term of this patent is extended or adjusted under 35 U.S.C. 154(b) by 0 days.

(21) Appl. No.: 18/665,813

(22) Filed: May 16, 2024

(51) Int. Cl.

| | |
|---|---|
| ***A47L 13/12*** | (2006.01) |
| ***A46B 5/00*** | (2006.01) |
| ***A46B 15/00*** | (2006.01) |
| ***A47L 13/42*** | (2006.01) |

(52) U.S. Cl.
CPC ..... *A47L 13/12* (2013.01); *A46B 5/0016* (2013.01); *A46B 5/0041* (2013.01); *A46B 5/0095* (2013.01); *A46B 15/0081* (2013.01); *A47L 13/42* (2013.01); *A46B 2200/302* (2013.01)

(58) Field of Classification Search
CPC ..... A47L 13/12; A46B 5/0016; A46B 5/0041; A46B 5/0095; A46B 15/0081
See application file for complete search history.

(56) References Cited

U.S. PATENT DOCUMENTS

| | | | |
|---|---|---|---|
| D239,480 | S | 4/1976 | Thomas |
| D358,714 | S | 5/1995 | Shaner |
| D364,742 | S | 12/1995 | Wells |
| D628,468 | S | 12/2010 | Camp, Jr. et al. |
| D804,123 | S | 11/2017 | Orsino |
| 10,383,501 | B2 | 8/2019 | Brown |
| D942,150 | S | 2/2022 | Bennett |

FOREIGN PATENT DOCUMENTS

| | | | | |
|---|---|---|---|---|
| DE | 102010055052 | A1 * | 6/2012 | ..... A46B 15/0069 |
| WO | WO-2020105937 | A1 * | 5/2020 | ..... A46B 5/0008 |
| WO | WO-2021125986 | A1 * | 6/2021 | ..... A45D 24/06 |

* cited by examiner

*Primary Examiner* — Shay Karls
(74) *Attorney, Agent, or Firm* — Cramer Patent & Design, PLLC.; Aaron R. Cramer

(57) ABSTRACT

The disclosed broom assembly combines a traditional broom with multiple pivotable attachments, offering a versatile cleaning solution. It features a head with a brush and bristles, attached to a shaft with a shaft coupler at one end and an attachment coupler at the other. This design allows various attachments, including a scraper, a smaller brush, a crevasse cleaner, and a spot cleaner, to pivot between a stowed and a deployed orientation. The stowed orientation keeps the attachments parallel to the shaft, while the deployed orientation extends them outward for use when the broom is rotated to an inverted position. This design offers a practical and adaptable cleaning tool suitable for a wide range of tasks without needing separate equipment.

2 Claims, 4 Drawing Sheets

BROOM ASSEMBLY

RELATED APPLICATIONS

None.

FIELD OF THE DEVICE

The presently disclosed subject matter is directed towards a broom assembly with multiple pivotable attachments, designed to offer versatile cleaning solutions. This assembly integrates various tools, such as scrapers, brushes, and spot cleaners, into a single unit, allowing users to easily switch between cleaning functions without the need for separate devices. The broom assembly provides a practical and efficient approach to managing different cleaning tasks, both in residential and commercial settings.

BACKGROUND OF THE DEVICE

Traditional brooms are often limited in their functionality, requiring additional tools for specific cleaning tasks, such as scrapers, corner brushes, or spot cleaners. This can lead to clutter, increased costs, and the inconvenience of switching between multiple tools. The broom assembly, with its integrated and pivotable attachments, addresses these limitations by providing a single, adaptable device capable of tackling a wide range of cleaning needs. This innovative approach streamlines the cleaning process, reduces the need for additional tools, and offers greater efficiency for users.

SUMMARY OF THE DEVICE

Embodiments of the present disclosure may include a broom assembly comprising a broom having a head and a shaft. In some embodiments, the head may include a brush with a plurality of bristles and a brush cap, while the shaft may have a shaft coupler at its lower end for coupling to the head, and an attachment coupler at its upper end for receiving a broom attachment.

In some embodiments, the broom may be designed to be used in an upright orientation. Additionally, the assembly may include a plurality of broom attachments pivotably coupled to the top of the shaft via the attachment coupler. Each of these broom attachments may be configured to pivot between a stowed orientation and a deployed orientation.

In some embodiments, the stowed orientation may position the broom attachment parallel to and adjacent to the shaft. The deployed orientation may extend the broom attachment beyond the top end of the shaft. This deployment configuration allows the broom to be rotated to an inverted orientation, enabling the broom attachment to operate near the floor.

The attachment coupler in some embodiments may include a shaft portion coupled to the top of the shaft and an attachment portion coupled to the broom attachment, allowing it to pivot by one hundred eighty degrees. The attachment portion of the attachment coupler may engage with the tops of different broom attachments, including a scraper attachment, a brush attachment, a crevasse attachment, and a spot cleaner attachment.

In some embodiments, the scraper attachment may comprise a scraper attachment blade and a scraper attachment handle, designed to scrape debris off the floor. The brush attachment may include brush attachment bristles and a brush attachment handle, and the brush attachment is smaller than the broom's head, enabling it to sweep corners and tight spaces.

In some embodiments, the crevasse attachment may comprise a crevasse attachment brush, a crevasse attachment brush spine, and crevasse attachment bristles, with the spine designed to align the bristles radially for cleaning narrow spaces. The spot cleaner attachment may include a spot cleaner head and a spot cleaner handle, with the spot cleaner head configured with a mop-like structure or sponge for targeted spot cleaning.

The attachment coupler may also include one or more detents to secure the broom attachment in specific positions during use. The detents can be implemented with a clevis, a tang, and a clevis pin, allowing for secure pivoting through one hundred eighty degrees. Alternatively, the detents may be implemented with a ball and a split socket, where the ball engages with the split socket to permit the broom attachment to pivot vertically through one hundred eighty degrees.

In some embodiments, the shaft coupler at the lower end of the shaft may be a female threaded aperture, and the head coupler may be a male threaded end, allowing for detachable coupling between the shaft and the head. These shaft and head couplers may be made from durable materials including plastic, fiberglass, hardwood, aluminum, or steel.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
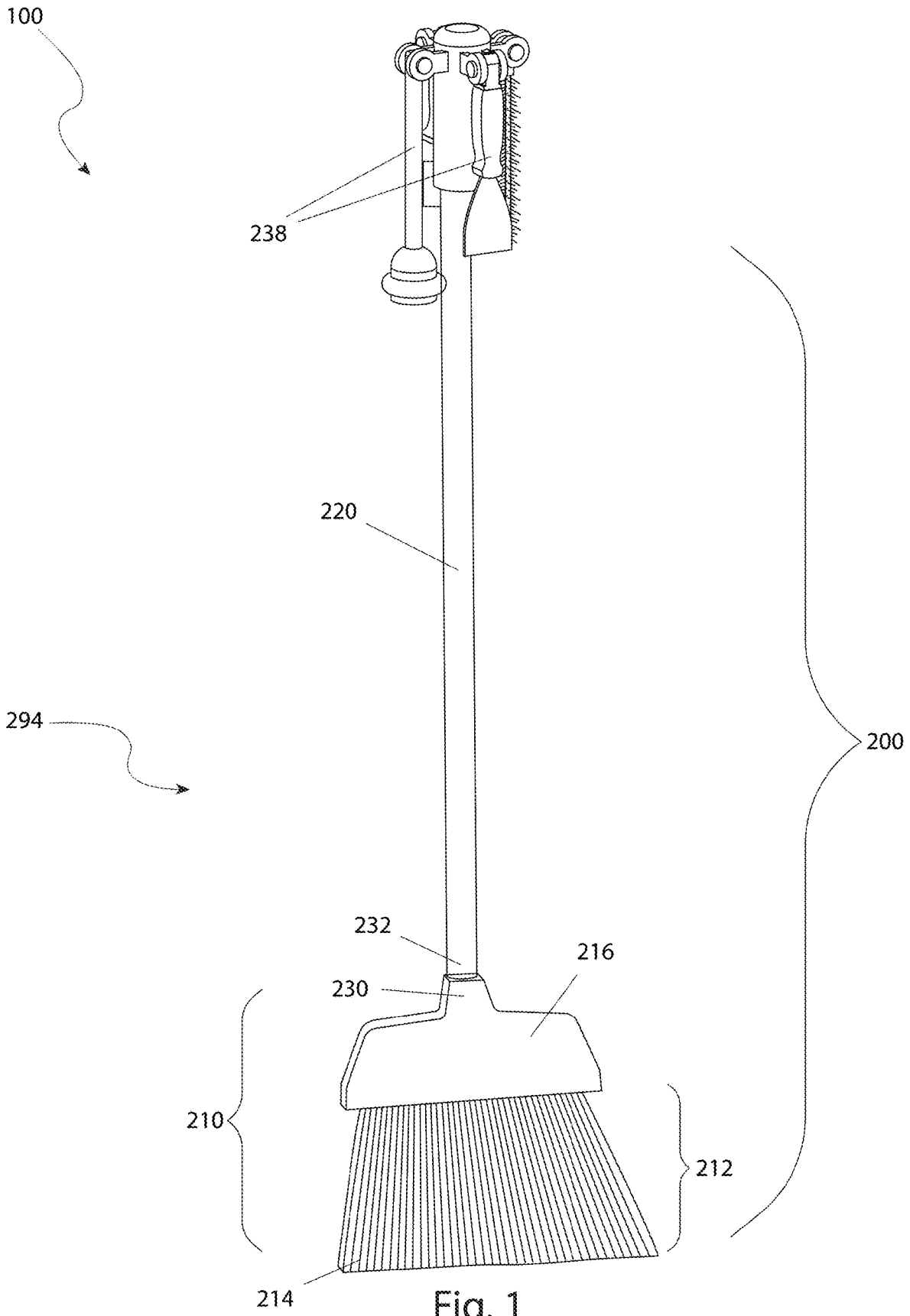
FIG. 1 is a front view of a broom assembly 100, according to an embodiment of the present invention, illustrating the broom 200 in the upright orientation 294.
Figure 4:
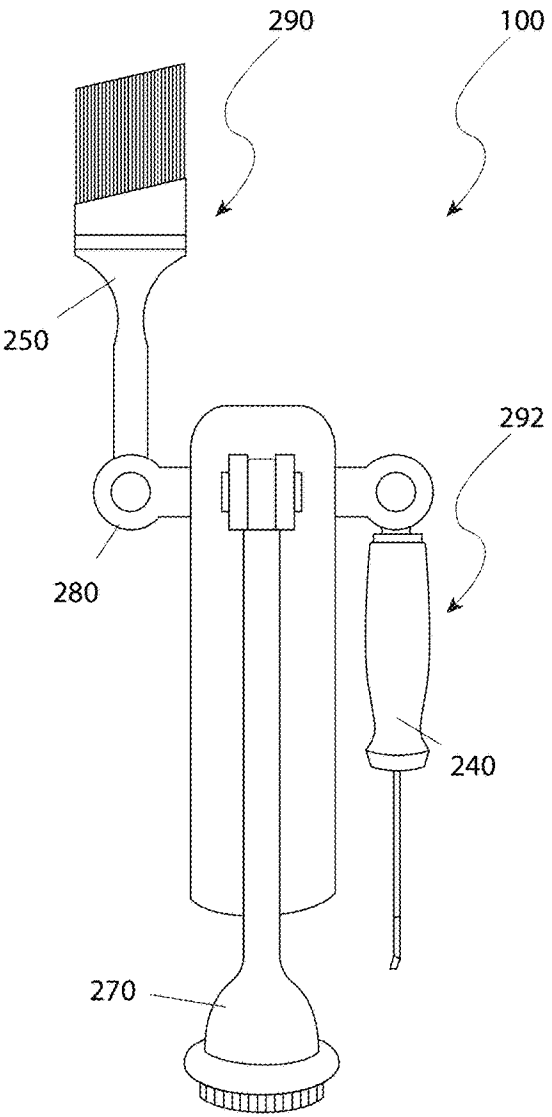
FIG. 4 is a detail view of a broom assembly 100, according to an embodiment of the present invention, illustrating a scraper attachment 240 in the stowed orientation 292, a brush attachment 250 in the deployed orientation 290, and a spot cleaner attachment 270.
Figure 3:
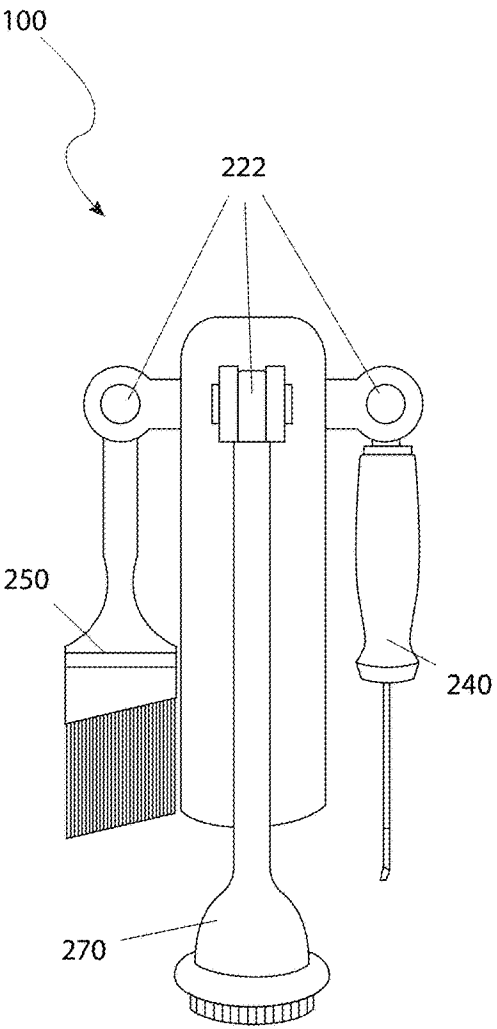
FIG. 3 is a detail view of a broom assembly 100, according to an embodiment of the present invention, illustrating a scraper attachment 240, a brush attachment 250, and a spot cleaner attachment 270.
Figure 2:
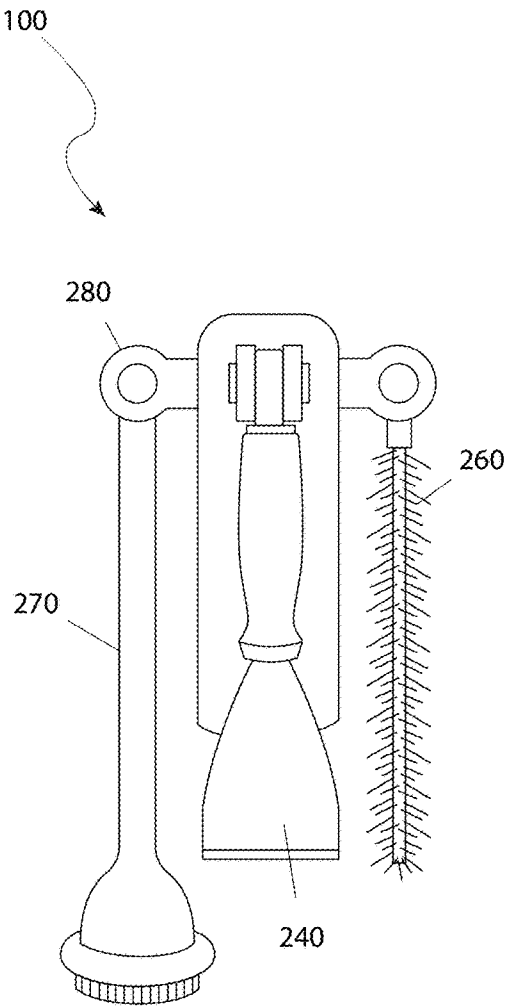
FIG. 2 is a detail view of a broom assembly 100, according to an embodiment of the present invention, illustrating a scraper attachment 240, a crevasse attachment 260, and a spot cleaner attachment 270.
Figures 5A, 5B, 5C, 5D:
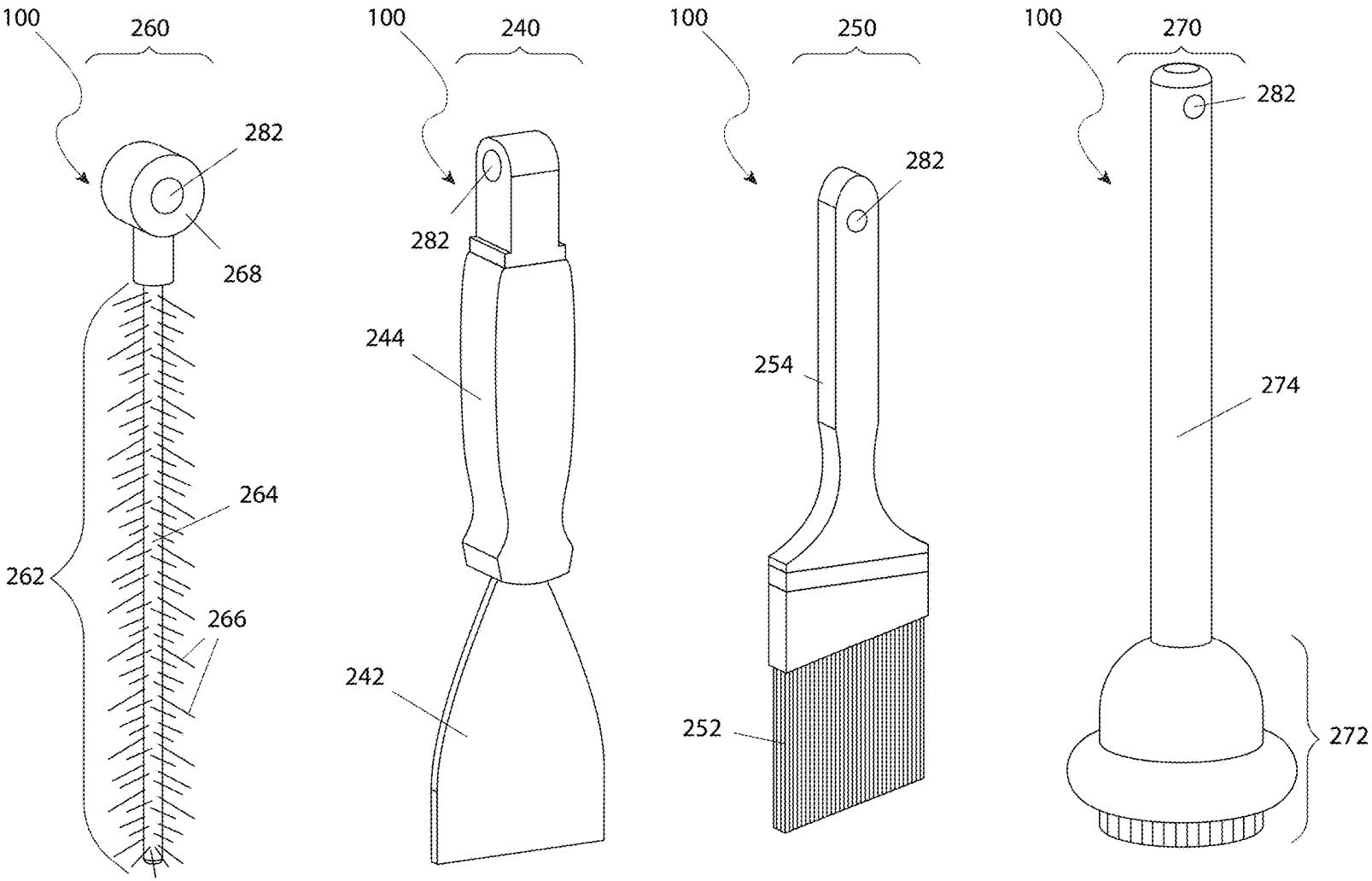
FIG. 5*a* is a detail view of a broom assembly 100, according to an embodiment of the present invention, illustrating a crevasse attachment 260.
FIG. 5*b* is a detail view of a broom assembly 100, according to an embodiment of the present invention, illustrating a scraper attachment.
FIG. 5*c* is a detail view of a broom assembly 100, according to an embodiment of the present invention, illustrating a brush attachment 250.
FIG. 5*d* is a detail view of a broom assembly 100, according to an embodiment of the present invention, illustrating a spot cleaner attachment 270; and, FIG. 6 is a front view of a broom assembly 100, according to an embodiment of the present invention, illustrating the broom 200 in the inverted orientation 296.
Figure 6:
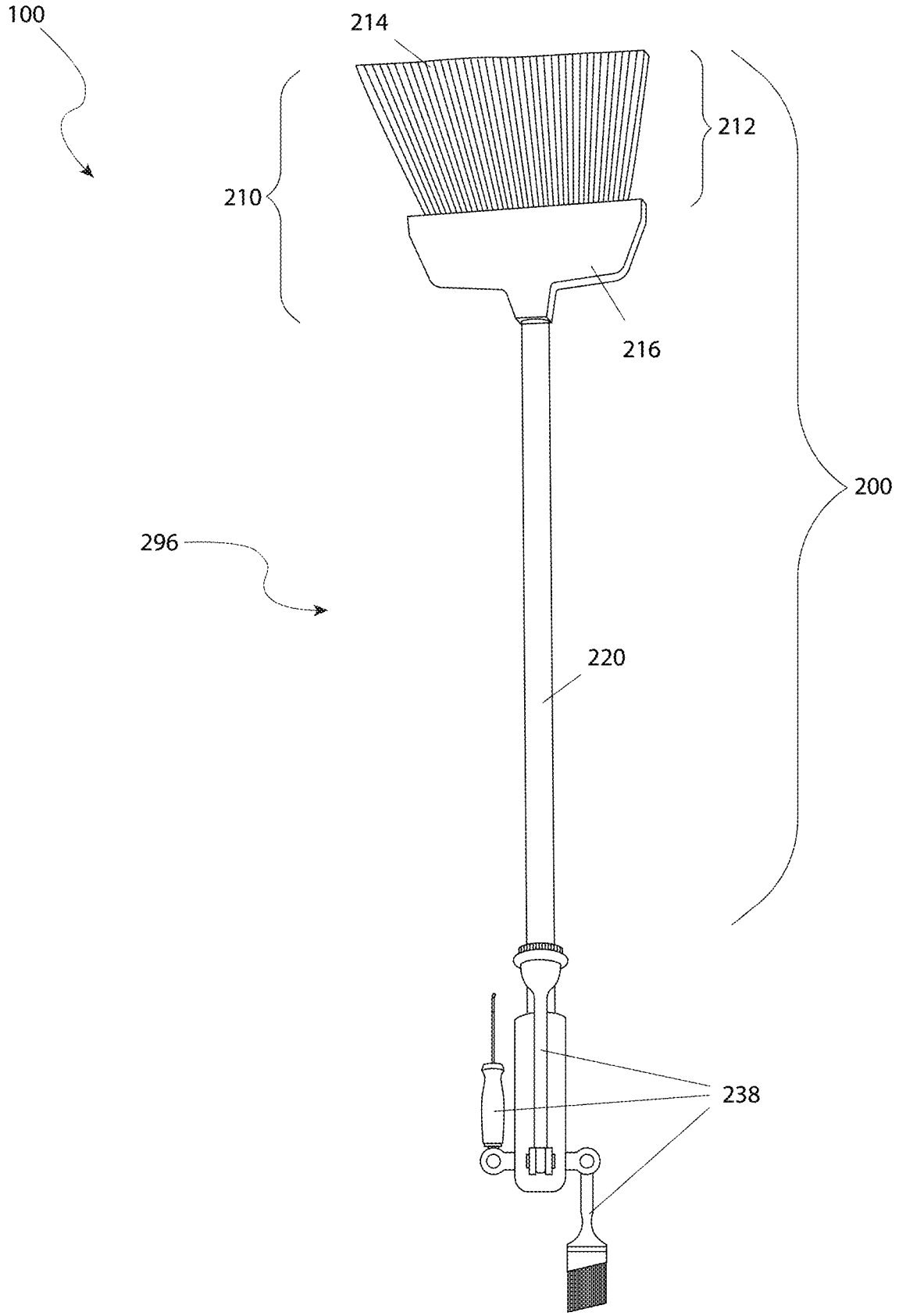

100 broom assembly
200 broom

210 head
212 brush
214 bristles
216 brush cap
220 shaft
222 attachment coupler
230 shaft coupler
232 head coupler
238 broom attachment
240 scraper attachment
242 scraper attachment blade
244 scraper attachment handle
250 brush attachment
252 brush attachment bristles
254 brush attachment handle
260 crevasse attachment
262 crevasse attachment brush
264 crevasse attachment brush spine
266 crevasse attachment brush bristles
268 crevasse attachment coupler
270 spot cleaner attachment
272 spot cleaner head
274 spot cleaner handle
280 shaft portion
282 attachment portion
290 deployed orientation
292 stowed orientation
294 upright orientation
296 inverted orientation

DESCRIPTION OF THE INVENTION

The present invention is directed to a broom assembly (herein described as the "invention") 100. The invention 100 may comprise a broom 200 and a plurality of broom attachments 238. The broom 200 may be adapted to sweep when held in an upright orientation 294. The plurality of broom attachments 238 may be pivotably coupled to the top of a shaft 220 of the broom 200. An individual broom attachment selected from the plurality of broom attachments 238 may pivot between a stowed orientation 292 and a deployed orientation 290. The stowed orientation 292 may position the individual broom attachment parallel to the shaft 220 and adjacent to the shaft 220. The deployed orientation 290 may position the individual broom attachment re-oriented by 180 degrees and extended beyond the top end of the shaft 220. The individual broom attachment may be used by rotating the broom 200 to an inverted orientation 296 such that the individual broom attachment that is in the deployed orientation 290 is lowered proximate to a floor.

The broom 200 may be a cleaning tool that may comprise a head 210 and the shaft 220. The head 210 may be brushed over a surface to sweep debris off of the surface. The shaft 220 may be adapted to be grasped by a user. The bottom of the shaft 220 may be coupled to the top of the head 210.

The head 210 may comprise a brush 212 and a brush cap 216. The brush 212 may comprise a plurality of bristles 214. The plurality of bristles 214 may be arranged to be approximately parallel to each other. The plurality of bristles 214 may have a length such that the bottom of the plurality of bristles 214 end in substantially the same plane.

As non-limiting examples, the plurality of bristles 214 may be made of synthetic fibers, natural fibers, or any combination thereof. By way of example and not of limitation, synthetic fibers may comprise polypropylene, nylon, polyethylene, acrylic, polyethylene terephthalate, and polyester. By way of example and not of limitation, natural fibers may comprise corn fiber, palmyra fiber, tampico fibers, and horsehair.

The brush cap 216 may shroud the tops of the plurality of bristles 214 and may retain the plurality of bristles 214 to the head 210. The top center of the brush cap 216 may couple to the shaft 220.

The shaft 220 may be a pole that couples to the head 210 and is operable as a handle for the broom 200. The shaft 220 may extend vertically upwards. As non-limiting examples, the shaft 220 may be made of plastic, fiberglass, hardwood such as ash, sycamore, beech, and maple, metal such as aluminum and steel, or any combination thereof.

In some embodiments, the head 210 may be detachable. The top of the head 210 may comprise a shaft coupler 230 and the bottom of the shaft 220 may comprise a head coupler 232. The shaft coupler 230 may comprise a female threaded aperture and the bottom of the shaft 220 may comprise a male threaded end. The threads of the shaft coupler 230 may be complementary to the threads of the head coupler 232 such that the bottom of the shaft 220 may screw into the top of the head 210 to retain the head 210 to the shaft 220. The head 210 may be removed by unscrewing the head 210 from the shaft 220.

The plurality of broom attachments 238 may be coupled to the top of the shaft 220 via a plurality of attachment couplers 222. In a preferred embodiment, there may be four (4) broom attachments and four (4) attachment couplers.

As non-limiting examples, the plurality of broom attachments 238 may comprise a scraper attachment 240, a brush attachment 250, a crevasse attachment 260, and a spot cleaner attachment 270. The scraper attachment 240 may comprise a scraper attachment blade 242 and a scraper attachment handle 244. The scraper attachment 240 may be operable to scrape debris off of the floor. The brush attachment 250 may comprise a brush attachment bristles 252 and a brush attachment handle 254. The brush attachment 250 may be smaller than the head 210 of the broom 200. The brush attachment 250 may be operable to sweep corners. The crevasse attachment 260 may comprise a crevasse attachment brush 262 and a crevasse attachment coupler 268. The crevasse attachment brush 262 may comprise a crevasse attachment brush spine 264 and a crevasse attachment brush bristles 266. The crevasse attachment brush bristles 266 may be coupled to the crevasse attachment brush spine 264 such that the crevasse attachment brush bristles 266 may be oriented radially with respect to the crevasse attachment brush spine 264. The crevasse attachment 260 may be operable to clean in narrow spaces. The spot cleaner attachment 270 may comprise a spot cleaner head 272 and a spot cleaner handle 274. The spot cleaner attachment 270 may be operable to remove spots. The spot cleaner head 272 may be configured to clean a spot when applied directly from above the spot. As non-limiting examples, the spot cleaner head 272 may comprise a mop strings or a sponge.

An individual attachment coupler selected from the plurality of attachment couplers 222 may comprise a shaft portion 280 and an attachment portion 282. The shaft portion 280 of the individual attachment coupler may be coupled to the top of the shaft 220. The attachment portion 282 of the individual attachment coupler may be coupled to top of the individual broom attachment. As non-limiting examples, the attachment portion 282 of the individual attachment coupler may be coupled to the tops of the scraper attachment handle 244, the brush attachment handle 254, the crevasse attachment coupler 268, and the spot cleaner handle 274. The shaft portion 280 of may engage the attachment portion 282 such that the individual broom attachment may pivot by one hundred eighty degrees (180°).

In some embodiments, the individual attachment coupler may comprise one (1) or more detents such that the individual broom attachment may be moved into a detent position and will remain in that position.

As a non-limiting example, the individual attachment coupler may comprise a clevis, a tang, and a clevis pin. The clevis may be coupled to the top of the shaft 220 and the tang may be coupled to the top of the individual broom attachment. The clevis pin may pivotably couple the tang to the clevis such that the tang may pivot vertically through one hundred eighty degrees (180°).

Alternatively, the individual attachment coupler may comprise a ball and a split socket. The split socket may be coupled to the top of the shaft 220 with the split oriented vertically. The ball may be coupled to the top of the individual broom attachment. The ball may engage the split socket such that the individual broom attachment may pivot vertically through one hundred eighty degrees (180°).

In use, the broom 200 may be held in an upright orientation 294 to sweep a floor using the head 210 of the broom 200 while grasping the shaft 220 of the broom 200. For some specific tasks, an individual broom attachment selected from a plurality of broom attachments 238 at the top of the shaft 220 may be pivoted from a stowed orientation 292 to a deployed orientation 290 and the broom 200 may be rotated to an inverted orientation 296. The individual broom attachment may be used at floor level without bending over.

In another non-limiting example the assembly consists of a broom 200 with a head 210 that includes a brush 212 composed of a dense array of bristles 214, retained by a brush cap 216. The broom 200 is connected to a shaft 220, which serves as the handle and is equipped with a shaft coupler 230 at its lower end, allowing it to attach to the head coupler 232. At the top end, the shaft 220 connects to multiple attachment couplers 222, providing flexibility in adding different broom attachments 238. The individual attachment couplers 222 consist of a shaft portion 280 and an attachment portion 282, facilitating secure and stable connections. This assembly incorporates a range of attachments designed for specific cleaning tasks. The scraper attachment 240, featuring a scraper attachment blade 242 and a scraper attachment handle 244, is ideal for scraping tough debris off floors. The brush attachment 250, with its smaller brush attachment bristles 252 and brush attachment handle 254, is designed for sweeping in corners and tight spaces. The crevasse attachment 260, comprising a crevasse attachment brush 262, crevasse attachment brush spine 264, crevasse attachment brush bristles 266, and crevasse attachment coupler 268, is tailored for cleaning narrow crevasses and other tight areas. The spot cleaner attachment 270, consisting of a spot cleaner head 272 and spot cleaner handle 274, is perfect for targeted spot cleaning, whether using mop-like strings or a sponge. Each attachment pivots between stowed orientation 292 and deployed orientation 290, depending on its use. The broom assembly 100 can be operated in an upright orientation 294 for standard sweeping or an inverted orientation 296 when using the broom attachments 238 in the deployed orientation 290. This versatility allows users to switch between attachments and orientations for various cleaning scenarios without the need for separate cleaning tools, making the broom assembly 100 a comprehensive solution for home and commercial cleaning.

The exact specifications, materials used, and method of use of the invention 100 may vary upon manufacturing. The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A broom assembly, comprising:

a broom having a head and a shaft, wherein the head includes a brush with a plurality of bristles retained by a brush cap, the plurality of bristles being arranged substantially parallel to each other and terminating in substantially the same plane for even sweeping; and, a plurality of broom attachments pivotably coupled to a top of the shaft via an attachment coupler, wherein the attachment coupler comprises a shaft portion coupled to the top of the shaft and an attachment portion coupled to each broom attachment, each broom attachment being configured to pivot between a stowed orientation and a deployed orientation; and, wherein the attachment coupler includes one or more detents to secure the broom attachments in specific angular positions during use, preventing unintended movement of the attachments, the detents being implemented using a clevis, tang, and clevis pin mechanism; and, wherein the shaft having a shaft coupler at one end for coupling to the head, the shaft coupler comprising a female threaded aperture and the bottom of the shaft having a male threaded end for detachable coupling to the head.

2. The broom assembly of claim 1, wherein the plurality of broom attachments comprises:

a scraper attachment including a scraper attachment blade and a scraper attachment handle, configured to scrape debris off the floor;

a brush attachment having smaller brush bristles than the main broom head and a brush attachment handle, designed for sweeping corners and tight spaces;

a crevasse attachment comprising a crevasse attachment brush with a brush spine and radially arranged bristles, the crevasse attachment being configured for cleaning narrow spaces; and a spot cleaner attachment including a spot cleaner head with a mop-like structure or sponge, and a spot cleaner handle, wherein the spot cleaner is operable for targeted spot cleaning by applying it directly over the desired cleaning area.

* * * * *